US005461985A

United States Patent [19]

Gersemsky

[11] Patent Number: 5,461,985

[45] Date of Patent: Oct. 31, 1995

[54] TRAVELING TROLLEY, IN PARTICULAR SINGLE-RAIL TROLLEY WITH COMPACT HEIGHT

[75] Inventor: Udo Gersemsky, Herdecke, Germany

[73] Assignee: Mannesmann Aktiengesellschaft, Dusseldorf, Germany

[21] Appl. No.: 226,946

[22] Filed: Apr. 13, 1994

[30] Foreign Application Priority Data

Apr. 13, 1993 [DE] Germany ..... 43 12 908.0

[51] Int. Cl.[6] ..... B61C 11/00

[52] U.S. Cl. ..... 105/30; 105/75; 105/154; 105/156; 105/112; 105/114; 104/95

[58] Field of Search ..... 105/30, 31, 33, 105/32, 73, 75, 96, 108, 112, 114, 141, 148, 150, 152, 153, 155, 156, 154; 104/89, 93, 95; 212/124, 125, 126, 131, 132

[56] References Cited

U.S. PATENT DOCUMENTS

| | | | |
|---|---|---|---|
| 2,617,365 | 11/1952 | Martin | 105/153 |
| 3,129,671 | 4/1964 | Vanderbeck | 105/153 |
| 3,498,236 | 3/1970 | Meek | 105/153 |
| 4,372,452 | 2/1983 | McCord | 105/153 |

FOREIGN PATENT DOCUMENTS

| | | | |
|---|---|---|---|
| 0546785 | 11/1922 | France | 212/124 |
| 254028 | 2/1912 | Germany . | |
| 0432859 | 11/1924 | Germany | 105/153 |
| 491527 | 1/1930 | Germany . | |
| 0803615 | 2/1951 | Germany | 212/124 |
| 1042857 | 11/1958 | Germany . | |
| 1259070 | 4/1969 | Germany . | |
| 2045659 | 3/1972 | Germany | 105/153 |
| 4209565A1 | 9/1993 | Germany . | |
| 1139759 | 6/1966 | United Kingdom | 212/124 |

*Primary Examiner*—Mark T. Le
*Attorney, Agent, or Firm*—Cohen, Pontani, Lieberman, Pavane

[57] ABSTRACT

The invention is directed to a traveling trolley, in particular a single-rail trolley having a compact height. A traveling trolley constructed in accordance with the present invention includes a supporting frame with running wheels that run on the bottom flange of a rail, a hoist arranged at the supporting frame, a lever member arranged at the axle of the driven running wheel so as to swivel or pivot, and a friction wheel supported at the free end of the lever member via an additional axle. The friction wheel and the driven running wheel are each coupled to a respective toothed wheel and these toothed wheels are driven by a driving unit. A spring element arranged between the lever member and the supporting frame urges the friction wheel into contact with the bottom flange of the rail.

12 Claims, 4 Drawing Sheets

TRAVELING TROLLEY, IN PARTICULAR SINGLE-RAIL TROLLEY WITH COMPACT HEIGHT

BACKGROUND OF THE INVENTION

1. Field of the Invention

This invention relates generally to traveling trolleys, and more particularly, to a single-rail trolley with a compact height.

2. Description of the Prior Art

A compact-height, travelling single rail trolley with a lifting mechanism or hoist is known from the published German Specification DE 42 09 565. In that publication, there is disclosed a trolley having wheels which run on the bottom flange of a rail and which are supported at a supporting frame. One of the wheels is driven and, rather than being connected directly with the supporting frame, is supported at a rocker which is arranged at the supporting frame so as to be pivotable. In addition, a friction wheel arranged at the rocker contacts the bottom flange of the rocker from below and forms a driving connection with the driven running wheel. The friction wheel and running wheel are arranged so as to be offset with respect to one another as seen in the traveling direction and can be adjusted at the bottom flange of the rail by swiveling the rocker so as to increase the frictional engagement. This swiveling movement is initiated on the one hand depending on load via the load acting on the supporting frame and, on the other hand, by a spring element arranged between the supporting frame and the rocker. Since the swiveling movement of the rocker causes a change in the position of the running wheel with respect to the bottom flange of the rail, the rocker is supported eccentrically. An adjustment of the eccentric changes the distance between the running wheel and the bottom flange and accordingly ensures that all running wheels are supported on the bottom flange.

Although this traveling trolley has proven advantageous in certain cases requiring great increases in frictional engagement, the arrangement of the supporting wheel and friction wheel at the rocker and the eccentric support of the latter at the supporting frame represents a costly solution when a substantial increase in frictional engagement is unnecessary.

In U.S. Pat. No. 2,617,365, it was proposed to provide a traveling trolley with a traveling mechanism or running gear for running on a rail and with a hoist arranged at the running gear. The running gear is connected via a tow bar with a driveable trolley unit provided with two running wheels which are movable on the bottom flange of the I-rail. Each running wheel is in a drive connection via toothed gears with a friction wheel which contacts the underside of the flange in the traveling direction so as to be slightly offset to the running wheels. The friction wheels are arranged on a shaft and driveable by a drive motor via a chain. The arrangement of the drive motor at a supporting plate in which the axle or shaft of the running wheel and friction wheel are fastened is effected in such a way that the inherent weight of the drive motor leads by way of the supporting plate acting as a lever to an increase in the contact pressure force of the running wheel and friction wheel against the bottom flange and accordingly to an increase in the frictional engagement.

A principal disadvantage of the configuration proposed in the aforementioned U.S. patent is that the connection of the running gear with the trolley unit via the tow bar results in a substantial increase in the constructional length of the traveling trolley. Moreover, although this type of construction guarantees an increase in the frictional engagement between the running wheel and friction wheel and the rail, this increase depends on the inherent weight of the drive motor and is very small. Further, this increase is not adjustable and does not allow for the different load situations of the traveling trolley.

A traveling trolley which carries a hoist and moves on the bottom flange of an I-rail by means of running wheels is proposed in German Patent DE-PS 1 259 070. The traveling trolley described therein is driven via a driven friction wheel which is pressed against the bottom flange from below. The contact pressure force can be applied and adjusted via a pretensioned spring. While this type of trolley drive is suitable in many cases owing to the adjustability of the contact pressure force of the friction wheel, the friction wheel must be manufactured from a rubber or plastic with good friction properties so as to transmit the requisite driving forces when the running wheels are not driven. This causes drive-related problems as a result of a decreased coefficient of friction due to moisture. Moreover, different loading states of the traveling trolley cannot be taken into account when adjusting the contact pressure force of the driven friction wheel.

A motor-driven traveling trolley with a non-driven counterwheel which is adjustable at the rail from below is proposed in German Patent Publication DE-PS 254 028. The counterwheel is arranged in a floating or oscillating manner at a supporting frame with running wheels, this arrangement being effected in such a way that a gap remains between the counterwheel and the rail when moving along horizontal portions of the rail and the counterwheel is pressed against the rail from below by means of the load acting indirectly thereon along ascending and descending stretches of the rail. Accordingly, a load-dependent increase in frictional engagement is effected between the wheels and the rail. Motor-driven trolleys of this kind enable a load-dependent increase in frictional engagement along ascending and descending lengths of the rail, but not along horizontal portions which are commonly used in traveling trolleys with hoists.

Another type of bottom-flange traveling trolley of compact height is also known from DE-PS 491 527. This traveling trolley substantially has a hoist, a supporting frame, a running gear with a drive mechanism, and a counterweight. The hoist and the drive mechanism are attached to opposite sides of the supporting frame engaging at the bottom of an I-shaped travel rail at roughly the same height as the rail. On the side of the supporting frame opposite the hoist, a counterweight is arranged in order to balance the traveling trolley in such a way that the center of gravity lies under the center of the rail. Although this short traveling trolley has a compact height, a counterweight is needed to balance the trolley due to the eccentric arrangement of the hoist. Accordingly, in addition to a disadvantageous increase in the inherent weight, the size of the traveling trolley is usually also increased, in particular when the counterweight is fastened at the supporting frame via lever arms.

It is therefore an object of the present invention to provide a single-rail trolley which has a low overall height, which is compact and simple to manufacture, and which includes a reliable drive.

SUMMARY OF THE INVENTION

The aforementioned objects, as well as others which will become apparent from the description set forth herein, are achieved by a traveling trolley having a supporting frame with running wheels supported at axles and run on the bottom flange of a rail. The trolley further includes a hoist arranged at the supporting frame, a drive unit for a running wheel, a lever member arranged at the axle of the driven running wheel so as to swivel, and a friction wheel supported at the free end of the lever member via an additional axle. The friction wheel is in a drive connection with the driven running wheel), and with a spring element which is arranged between the lever member and the supporting frame for adjustment of the friction wheel at the bottom flange of the rail.

Preferably, the friction wheel is arranged between the running wheels as seen in the traveling direction. Moreover, the friction wheel and the driven running wheel may be connected respectively with a corresponding toothed wheel, the toothed wheels being dimensioned and arranged to engage with one another. The friction wheel may, if desired, be constructed so as to be integral with the toothed wheel associated therewith. Similarly, the driven running wheel may be constructed so as to be integral with the toothed wheel connected thereto.

In accordance with another aspect of the invention, the lever element is constructed in a substantially belt-shaped manner and a drive unit, which is in a drive connection with the toothed wheel of the friction wheel via a driven toothed wheel, is arranged at the end of the lever member remote of the axle of the driven running wheel.

Advantageously, a running wheel is arranged in each instance directly on the side of the housing of the hoist facing the bottom flange in the front and in the back as seen in the traveling direction. The hoist and the lever member with the friction wheel are arranged at opposite sides of the rail as seen transversely to the traveling direction. Load bearing means connected with the hoist, as considered suspended below the rail and transversely to the traveling direction, are arranged so as to be offset from the center by a distance (a) toward the friction wheel.

A novel aspect of the present invention is that an individual running wheel, in particular that wheel located opposite the friction wheel, is driven in addition to the friction wheel which is adjusted via a spring against the bottom flange of the rail. A substantial advantage is achieved thereby in that, in addition to the increased frictional engagement between the friction wheel and rail and, indirectly, also between the running wheels and the rail, a load-dependent increase in frictional engagement between the driven running wheel and the rail is also achieved by means of the forces transmitted via the supporting frame and running wheels.

Due to the drive connection between the friction wheel and the running wheel, driving forces are transmitted to the rail not only by the friction wheel but by the running wheel as well, so that only this pair of wheels need be driven and costly drive connections between the running wheels, in particular to the running wheel on the opposite side of the rocker, can be dispensed with.

The arrangement of the friction wheel between the running wheels, as seen in the traveling direction, leads to a distribution of the contact pressure forces of the friction wheel to the four running wheels and accordingly to a particularly stable four-point support of the running wheels. Moreover, the substantially strip-shaped or belt-shaped construction of the lever member, at whose end remote of the running wheel is arranged a drive mechanism, results in a particularly compact constructional subassembly or module allowing the friction wheel drive to be adapted to existing conditions in a simple manner.

Additionally, a compact construction is achieved as a result of the position of the lever member and the arrangement of two running wheels at the side of the housing of the hoist facing the rail. Accordingly, it is possible to provide an L-shaped construction of the supporting frame as seen in the traveling direction, since the hoist forms the remaining portion of the traveling trolley engaging the bottom flange in a U-shape. Further, when the traveling trolley according to the invention is constructed as a single-rail trolley with a compact height, there is no need to arrange a counterweight on the side opposite the hoist, since the arrangement of the running wheels directly at the housing of the hoist results in a less eccentric arrangement of the hoist on the one hand and the residual forces are transmitted from the friction wheel into the bottom flange of the rail on the other hand. The resulting wheel pressure of the friction wheel from below is transmitted to the running wheels via the lever member. Further, the torsional strain on the rail is reduced in that the load bearing means are arranged so as to be slightly offset from the center of the rail to the drive mechanism.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The present invention will be described in the following detailed description with reference to the accompanying drawings, in which.

DETAILED DESCRIPTION OF THE PREFERRED EMBODIMENTS

Figure 1:
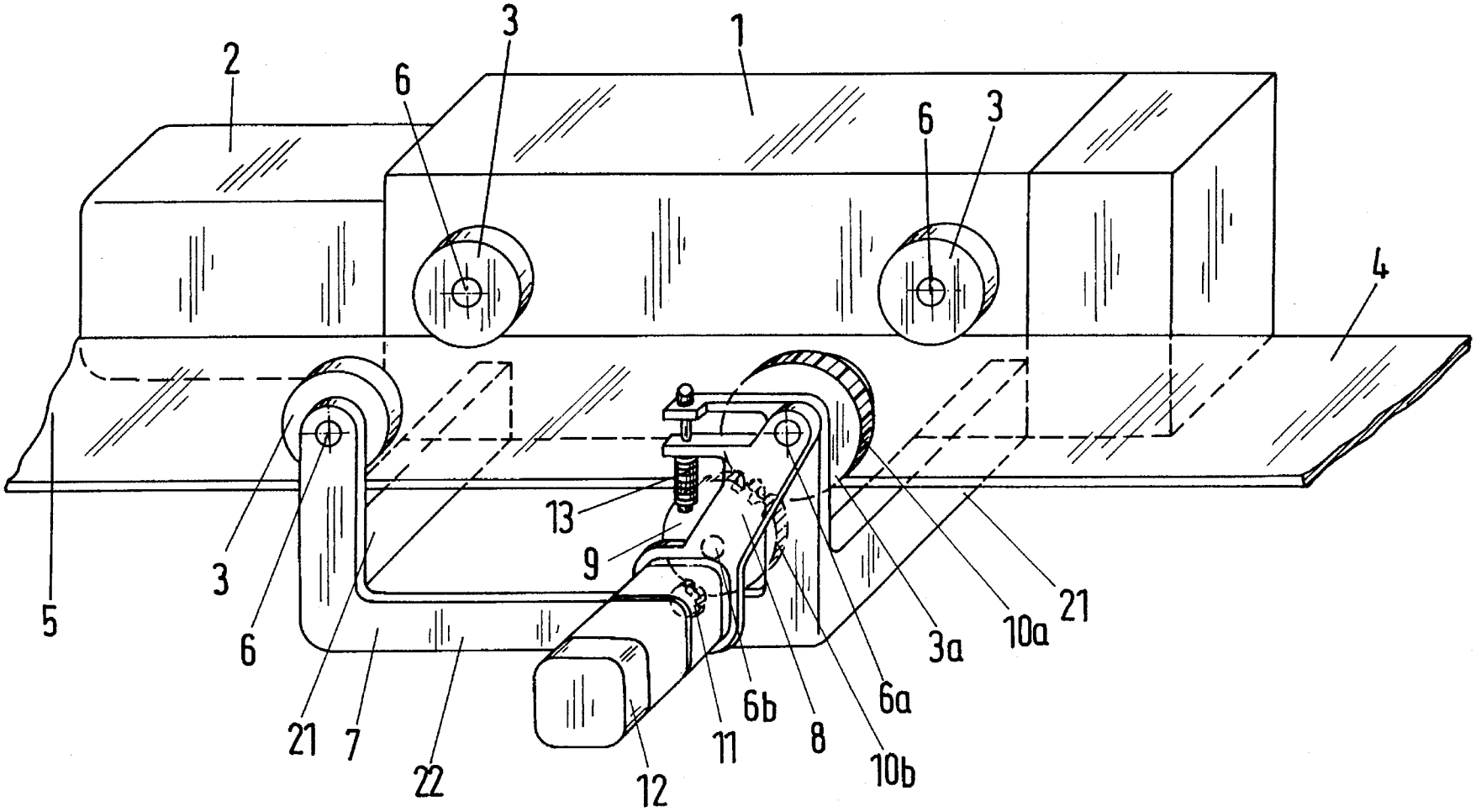
FIG. 1 shows an exploded view of a single-rail trolley with a compact height.

FIG. 1 is an exploded view of the traveling trolley according to the invention. As seen in FIG. 1, the traveling trolley includes a hoist 1 with an electric motor drive 2 and a running gear with three running wheels 3 which are not driven and one driven running wheel 3*a*. Each of the wheels is adapted to roll upon a bottom flange 4 of an I-rail 5, only a section of which is shown in FIG. 1.

With continued reference to FIG. 1, it will be observed that a supporting frame 7 having a pair of parallel L-shaped frame sections 21 is connected to the hoist 1. The L-shaped frame sections 21 are arranged one after the other as seen in the traveling direction and are connected with one another at the end remote of the hoist via a crossbar section 22 oriented parallel to the traveling direction.

As shown in FIG. 1, a pair of non-driven running wheels 3, 3 is rotatably secured to the first L-shaped frame section 21 and to the housing of hoist 1 by means of aligned axles 6, 6. Similarly, a second pair of running wheels, comprising a non-driven wheel 3 and driven wheel 3*a*, is rotatably secured to the second L-shaped frame section 21 by means of aligned axles 6 and 6*a*, respectively. As shown, the hoist 1 and supporting frame 7 collectively define a U-shaped profile when viewed in the traveling direction, with the wheels engaging the surface of bottom flange 4 and the base of the L-shaped sections being disposed beneath bottom flange 4.

With continued reference to FIG. 1, it will be seen that a lever member 8 is supported at the axle 6*a* of the driven running wheel 3*a* and that a friction wheel 9 is arranged at this lever member 8 via another axle 6*b*. The friction wheel 9 contacts the bottom flange 4 from below and, for a purpose which will soon become apparent, is arranged so as to be offset from the running wheel 3*a* as seen in the traveling direction. The axles 6*a*, 6*b*, which are arranged parallel to one another and transversely to the traveling direction, are in driving relation with one another via toothed gears 10*a*, 10*b* attached to the axles 6*a*, 6*b*. The running wheel 3*a* is driveable via a driven or output gear 11 of a drive unit 12. The toothed wheels 10*a*, 10*b* are preferably constructed as rim gears or toothed rims and form a component part of the running and friction wheels 3*a*, 9, respectively. The lever member 8 which is swivelable around the axle 6*a* arranged at the supporting frame 7 can be adjusted by a spring element 13 supported at the supporting frame 7 so that the friction wheel 9 is pressed against the bottom flange 4 of the rail 5 from below by means of the swiveling of the lever member 8 and the carrying wheel 3*a* is pressed on the bottom flange 4 indirectly from above. Accordingly, in addition to the load-dependent increase in frictional engagement for the carrying wheels 3*a*, the frictional engagement of the running and friction wheels 3, 3*a*, 9 can also be increased by means of the load acting on the supporting frame 7 so as to ensure an adequately non-slip operation for all load situations and under all conditions of use, e.g. moisture.

Figure 2:
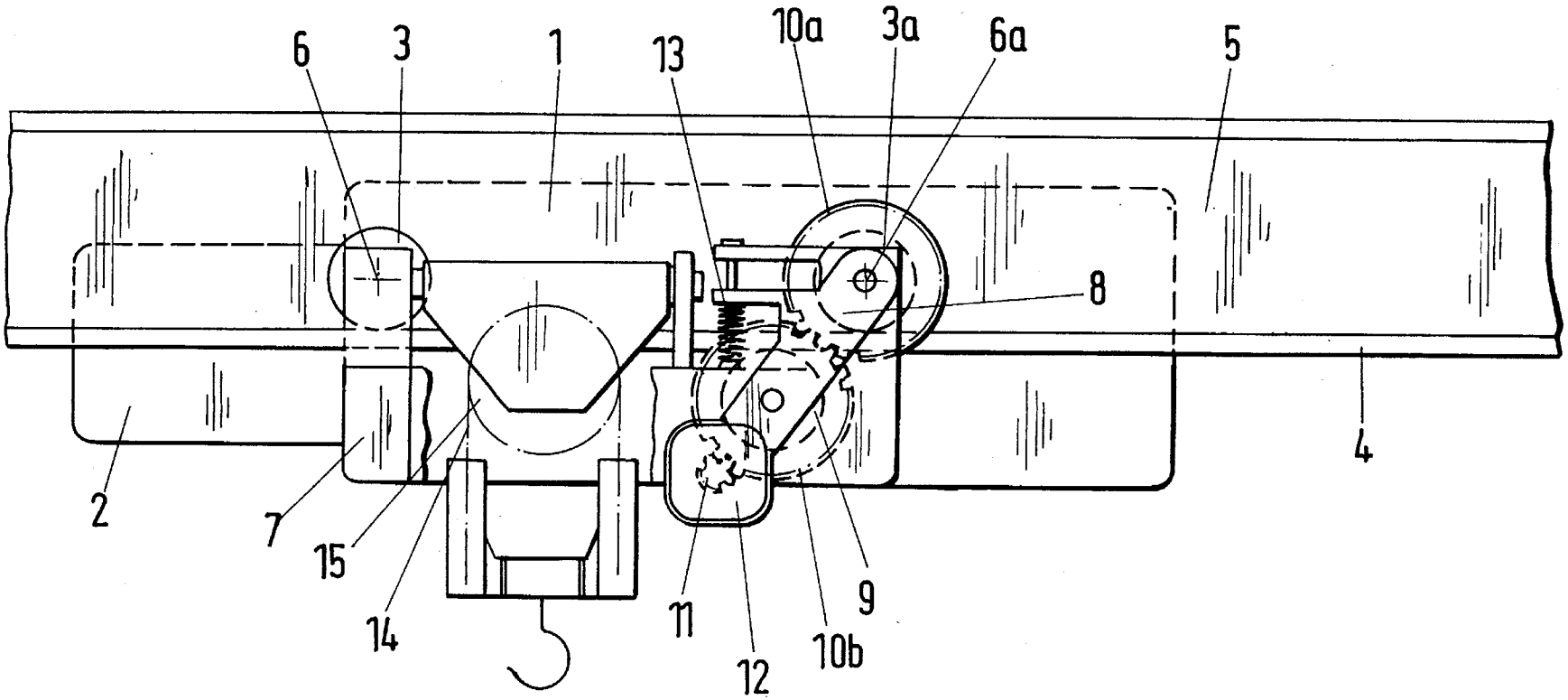
FIG. 2 shows a side view of a single-rail trolley with a compact height.

FIG. 2 shows a side view of the single-rail trolley with a compact constructional height. In addition to FIG. 1, it can be seen that the lifting cable 14 is reeved around a cable roller 15 arranged at the supporting frame 7 with a 4/1 reeve. The fixed point 19 (see FIG. 3) of the lifting cable 14 is located at the hoist 1. In this embodiment form, the hoist 1 is arranged with respect to its longitudinal direction so as to lie parallel to, laterally adjacent to, and at roughly the same height as the bottom flange 4 of the rail 5.

Figure 3:
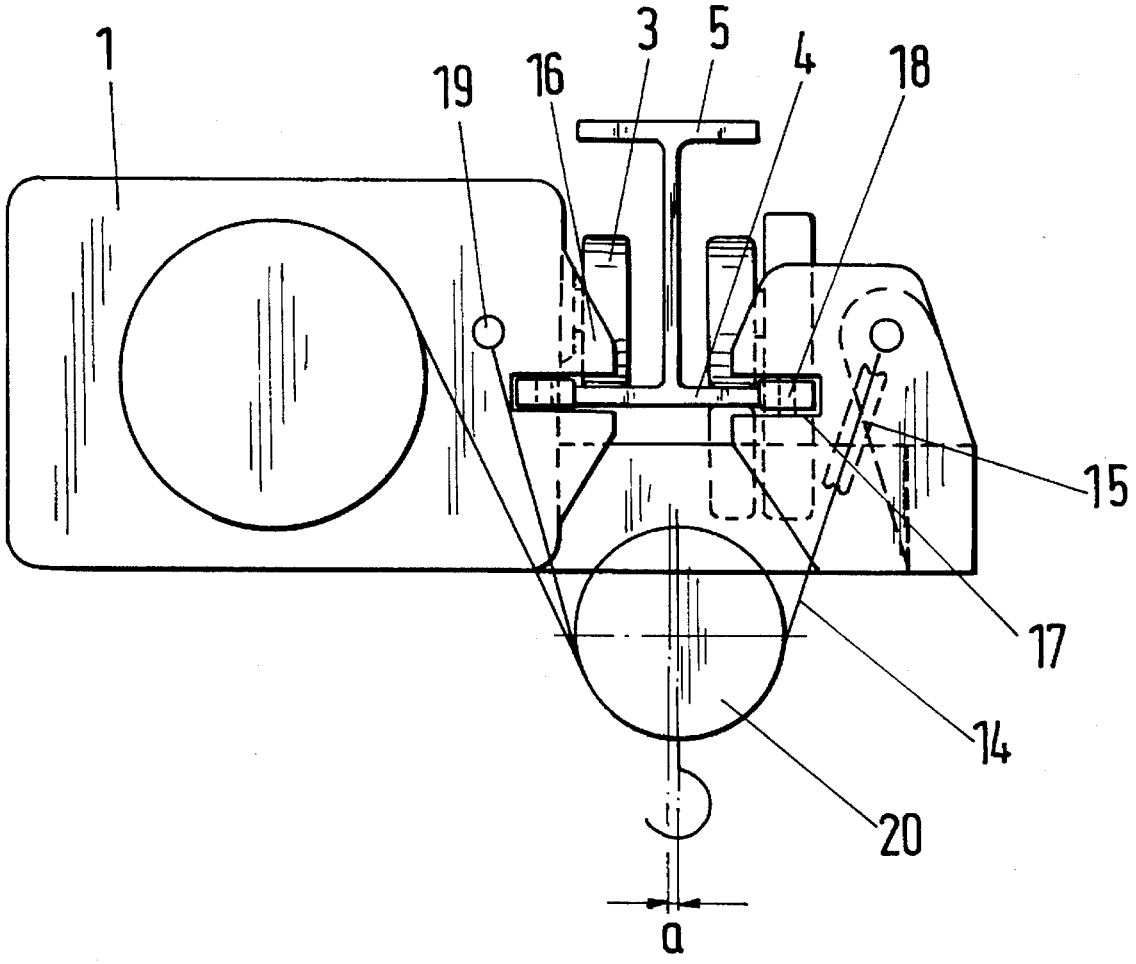
FIG. 3 shows a front view with reference to FIG. 2.

FIG. 3 shows a front view with reference to FIG. 2 showing the direct fastening of two running wheels 3 to the side of the housing of the hoist 1 facing the I-shaped rail 5. The housing of the hoist 1 and the supporting frame 7 are provided at the front and back, as seen in the traveling direction, with oppositely located triangular projections 16 forming U-shaped cut out portions 17. The cut out portions 17 enclose the bottom flange 4 of the rail 5 so as to leave a gap. A guide roller 18 which is rotatable around a vertical axis and rolls along the sides of the bottom flange 4 is arranged in each cut out portion 17. The projections 16 serve to prevent the trolly from falling.

Further, it will be seen that the center of the load bearing means 20 is arranged so as to be offset by a distance a from the center of the rail 5 toward the lever member 8. The distance $\alpha$ corresponds to the eccentric inherent weight effect of the hoist 1, in this case, an electric hoist 1, at maximum load of the traveling trolley so that the torsional strain on the rail 5 is minimal at maximum loading of the traveling trolley.

Figure 4:
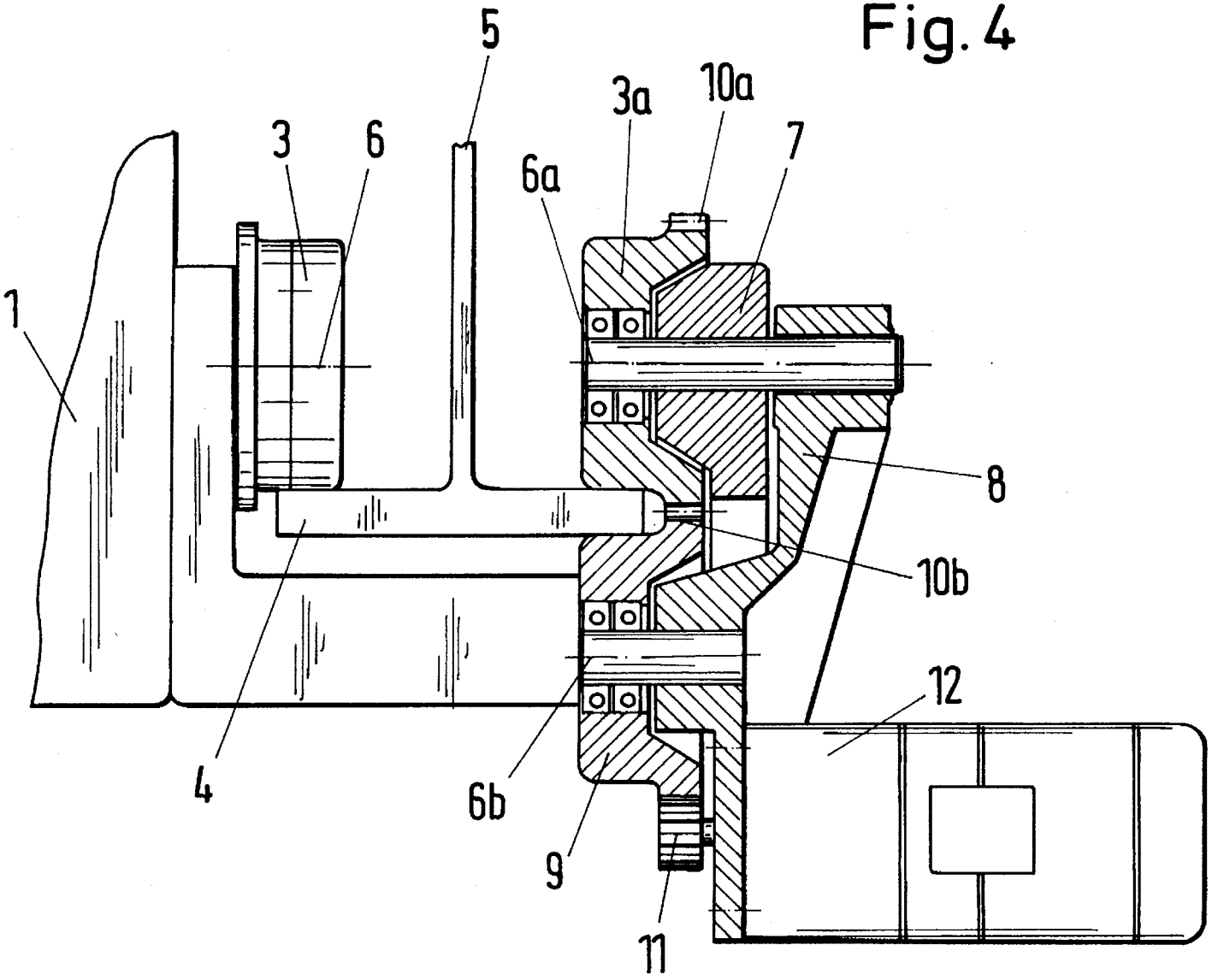
FIG. 4 is an enlarged partial view with reference to FIG. 2 showing a section in the region of the lever member.

FIG. 4 shows an enlarged partial view of FIG. 2 with a sectional view in the region of the lever member 8. The lever member 8 is swivelably supported at one end on the axle 6*a*. The axle 6*a* is supported in turn in the supporting frame 7 and, on the side remote of the lever member 8, serves to support the driven running wheel 3*a* with the toothed wheel 10*a* which is cast integral therewith. The lever member 8, which is substantially strap shaped, has an additional bore hole in its center for receiving the axle 6*b* on which is supported the friction wheel 9 with the toothed wheel 10*b* cast integral therewith. The gear ratio of the toothed wheels 10*a*, 10*b* corresponds to the ratio of the diameter of the running wheel 3*a* to that of the friction wheel 9. The lever member 8 is widened at the end remote of the axle 6*a* for the running wheel 3*a* so as to provide a flange for the drive unit 12 and is provided with a bore hole accommodating the output shaft of the drive unit 12. The output gear 11 that meshes with the toothed wheel 10*b* of the friction wheel 9 is arranged on the output shaft.

The invention is not limited by the embodiments described above which are presented as examples only but can be modified in various ways within the scope of protection defined by the appended patent claims.

What is claimed is:

1. A compact-height travelling trolley for use on a single rail having a bottom flange, comprising:

a supporting frame;

a hoist including a hoist housing;

a first pair of non-driven running wheels movable along an upper surface of the bottom flange, one of said running wheels being rotatably secured to said hoist housing and the other of said running wheels being rotatably secured to said supporting frame;

a second pair of running wheels movable along the bottom flange upper surface, one of said second pair of running wheels being non-driven and rotatably secured to said hoist housing and the other of said second pair of running wheels being a driven wheel rotatably secured directly on a wheel axle fixed directly to said supporting frame;

a lever member pivotally secured to said supporting frame proximate said driven wheel;

a friction wheel rotatably secured to said lever member, said friction wheel being adapted to engage a bottom surface of the bottom flange;

means for driving said friction wheel and said driven wheel whereby said friction wheel is in drive connection with said driven wheel; and means for urging said friction wheel into engagement with the bottom surface of the bottom flange.

2. The travelling trolley according to claim 1, wherein said friction wheel is arranged between said first and second pairs of running wheels as seen in the traveling direction.

3. The travelling trolley according to claim 1, wherein said means for driving comprises a first toothed wheel coupled to said friction wheel for rotation therewith, a second toothed wheel coupled to said driven running wheel for rotation therewith and engageable with said first tooth wheel, and a driving unit for driving said toothed wheels.

4. The travelling trolley according to claim 3, wherein said friction wheel and said first toothed wheel are integrally formed and said driven running wheel and said second toothed wheel are integrally formed.

5. The travelling trolley according to claim 3, wherein said lever member is a thin, elongated member pivotally secured to said supporting frame at a first end and wherein said driving unit is secured to said lever member at a second end thereof and includes a driving gear engageable with said first toothed wheel.

6. The travelling trolley according to claim 1, wherein a running wheel of each pair of running wheels is arranged on a side of the hoist housing facing the bottom flange in the from and in the back as seen in a trolley travelling direction.

7. The travelling trolley according to claim 1, wherein said hoist and said lever member are arranged at opposite sides of the rail as seen transversely to a trolley travelling direction.

8. The travelling trolley according to claim 7, further including load bearing means connected with the hoist, said load bearing means being suspended below the rail and oriented transversely to said traveling direction so as to be offset from the center by a selected distance relative to said friction wheel.

9. The travelling trolley according to claim 1, wherein said urging means comprises a spring element arranged between the lever member and said supporting frame.

10. The travelling trolley according to claim 1, wherein said supporting frame comprises first and second parallel L-shaped sections coupled to said housing and extending parallel therefrom, a running wheel of said first pair and the driven wheel of said second pair become secured to said first L-shaped section and said second L-shaped section, respectively.

11. The travelling trolley according to claim 10, wherein said lever member depends downwardly from said second L-shaped section and wherein said lever member and said driven wheel are coupled thereto by a common axle member.

12. The travelling trolley according to claim 10, wherein said second L-shaped section includes a first projection extending in a trolley travelling direction, wherein said lever member includes a second projection extending in said trolley travelling direction, and wherein said urging means comprises a spring arranged to bias said second projection relative to said first projection.

* * * * *